US005528560A

United States Patent [19]

Ogiyama

[11] Patent Number: 5,528,560

[45] Date of Patent: Jun. 18, 1996

[54] TIMEPIECE RECEPTIVE OF A BROADCAST TIME-SIGNAL FOR CORRECTING A TIME ERROR

[75] Inventor: Moriyasu Ogiyama, Tokyo, Japan

[73] Assignee: Seikosha Co., Ltd., Japan

[21] Appl. No.: 978,625

[22] Filed: Nov. 19, 1992

[30] Foreign Application Priority Data

Nov. 19, 1991 [JP] Japan ..... 3-303438

[51] Int. Cl.[6] ..... G04C 11/02

[52] U.S. Cl. ..... 368/47

[58] Field of Search ..... 368/47, 55

[56] References Cited

FOREIGN PATENT DOCUMENTS 0258838 3/1988 European Pat. Off. .

3144321 5/1983 Germany .

*Primary Examiner*—Bernard Roskoski

*Attorney, Agent, or Firm*—Adams & Wilks

[57] ABSTRACT

A timepiece for receiving a broadcast time signal containing correct time data for correcting a time error. A control circuit controls reception of the broadcast time signal depending on a time error. A current time is counted, and a time error dependent on the correct time data and the current time is determined for adjusting the current time. The reception of the broadcast time signal is controlled at intervals or times which are dependent on the time error obtained at a preceding adjustment operation so that the reception operation is executed only when necessary, thereby reducing power consumption.

45 Claims, 8 Drawing Sheets

START
4a
Power on or reset
4b
Start receiving
4c
Correct data received?
No
Yes
4d
A = A + 1
4e
A > 10 ?
No
Yes
4f
Adjust time
4i
5 → B
4g
Store next receiving date·time
4h
Receiving date·time ?
Yes
No

TIMEPIECE RECEPTIVE OF A BROADCAST TIME-SIGNAL FOR CORRECTING A TIME ERROR

BACKGROUND OF THE INVENTION

The present invention pertains to a timepiece which is receptive of a broadcast time signal for correcting a time error on the basis of the received time signal. More particularly, the present invention pertains to a timepiece receptive of a broadcast time signal for correcting a time error and having circuitry for reducing the consumption of power.

Japan has recently begun broadcasting, on a trial basis, a time code signal which is superposed on a standard frequency long radio wave. This time code signal is being broadcast under the control of the Ministry of Posts and Telecommunications, and is effective for correcting a time error in timepieces that are receptive of the time signal. The broadcast time signal includes correct time data indicative of hours and minutes of the days accumulated since January 1 , and the data are transmitted in series in the form of a binary code having one frame per minute.

More specifically, the time signal is broadcast having one bit formed by a 1-Hz square pulse. The binary values of "1" and "0" are represented by pulse widths of 500 ms and 800 ms, respectively. Position markers are represented by 200 ms pulses, and the carrier wave has a frequency of 40 KHz.

In order to make use of the broadcast time signal for correcting a time error, timepieces are being provided with a receiving circuit. The receiving circuit is supplied power each day at a predetermined time and for a constant time interval. Thus, the receiving circuit can receive the broadcast time signal having correct time data so as to adjust for discrepancies of time in the timepiece.

However, since the time signal is received by the timepiece every day at a predetermined time, the timepiece is adjusted every day. The timepiece is adjusted in spite of the fact that daily time adjustment may be unnecessary if the precision of the particular timepiece is high. Therefore, a problem exists in that power may be unnecessarily consumed each time the timepiece receives the time code signal.

SUMMARY OF THE INVENTION

An object of the present invention is to provide a timepiece that selectively receives a time code signal only when reception is determined to be necessary.

Another object of the present invention is to provide a timepiece which can save power consumption by receiving the time code signal only when necessary.

In accordance with the present invention, a timepiece has receiving means for receiving a broadcast time signal containing correct time data. Reception control means controls the reception of the broadcast time signal by the receiving means. Time counting means counts a current time. Adjusting means determines a time error dependent on the correct time data and the current time. The adjusting means also adjusts the current time counted by the time counting means dependent on the time error. A control circuit controls the reception control means dependent on the time error. In this manner, the control circuit conserves the power consumed by the timepiece by controlling the reception of the broadcast time signal only to times when reception is determined to be necessary.

The control circuit controls the adjusting means and includes means for determining whether the correct time data is sufficiently received when the receiving means is receiving the broadcast time signal data, or in other words, when the received broadcast time signal is useful for its intended purpose. Counting means counts a number of times the time data is not sufficiently received, and comparing means compares the number of times the time data is not sufficiently received with a predetermined number. If, however, the number of times the time data is not sufficiently received exceeds the predetermined number, the control circuit controls the adjusting means to determine the time error on the basis of a predetermined value. If the time data is correctly received, the control circuit controls the adjusting means to determine the time error and adjust the current time on the basis of the received time data.

Time error storing means is provided for storing the time error and reception time storing means is provided for storing a predetermined reception time. The control circuit includes determining means for determining whether the time error exceeds a predetermined value at the predetermined reception time. If the time error exceeds the predetermined value, then the control circuit controls the reception control means to receive the broadcast signal. However, if the time error does not exceed the predetermined value, then the time error is incremented.

The control circuit also includes means for deciding a next reception date and time depending on the time error. The control circuit controls the reception control means to receive the broadcast signal at the next reception date and time. Also, reception date and time storing means may be provided for storing the next reception date and time, which has a value depending on the time error.

An elapsed time counting circuit is provided for counting a predetermined elapsed time. The control circuit operates at the predetermined elapsed time for controlling the reception control means to receive the broadcast time signal. The control circuit includes means for resetting the predetermined elapsed time depending on the time error.

Thus, in accordance with the present invention, a timepiece receives the broadcast time signal for adjusting the time of the timepiece only when it is determined that such reception is necessary thereby conserving power.

DETAILED DESCRIPTION OF THE INVENTION

Figure 1:
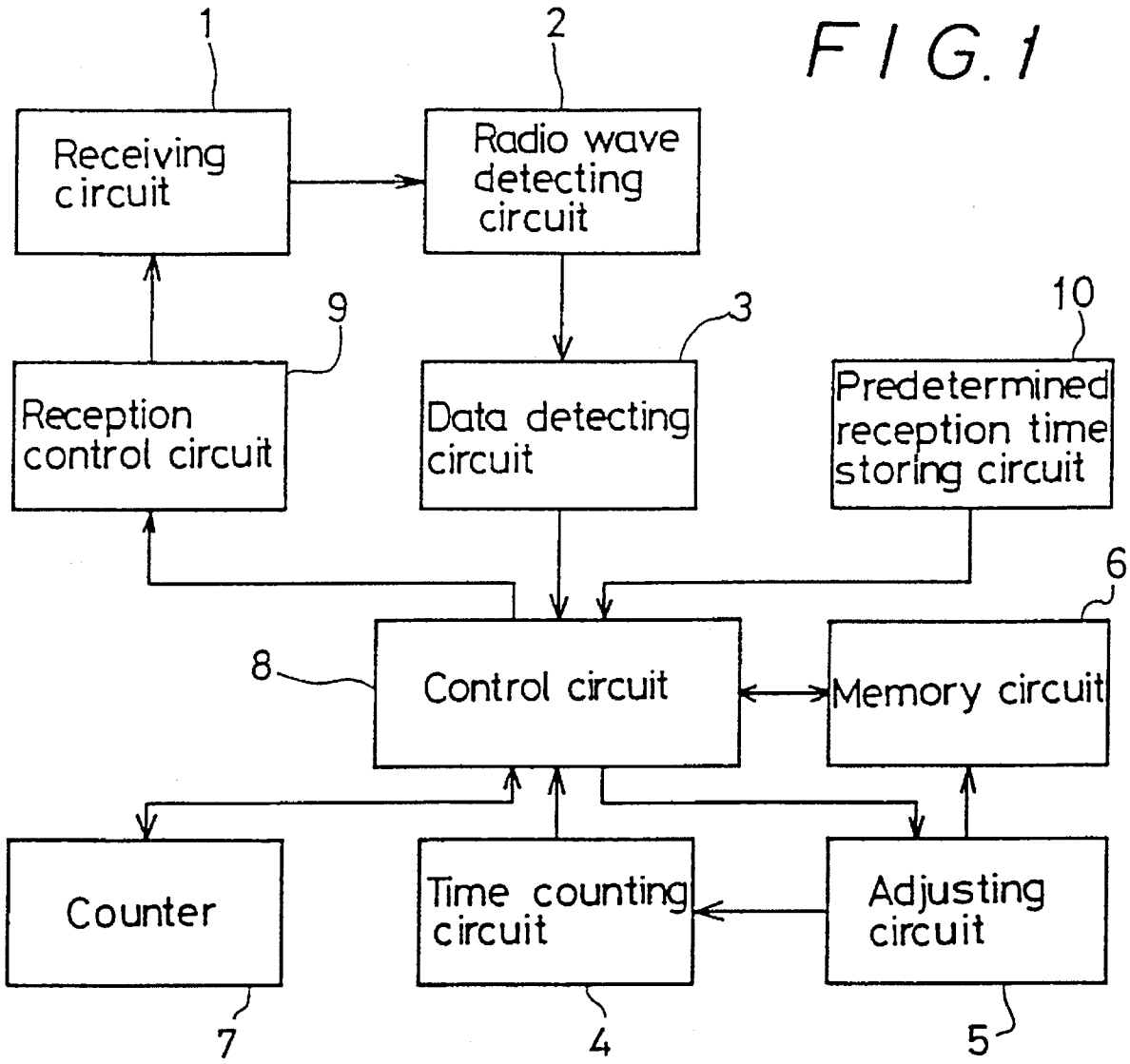
FIG. 1 is a block diagram showing an embodiment of a timepiece according to the present invention.

Referring to FIG. 1, an embodiment of the present invention will be described in more detail. A receiving circuit 1 having an antenna, a tuning circuit and an amplifier, is provided for receiving a broadcast time signal containing correct time data. For example, in Japan the receiving circuit 1 is effective to receive the time code signal superposed on a standard frequency long radio wave which is transmitted under control of the Ministry of Posts and Telecommunications. A radio wave detecting circuit 2 shapes the signal wave form received by the receiving circuit 1.

A data detecting circuit 3 detects the time data output from the radio wave detecting circuit 2. A time counting circuit 4 is provided for counting a current time. An adjusting circuit 5 is provided for determining a time error which is dependent on the correct time data received by the receiving circuit 1. A memory circuit 6, composed of a RAM or the like, stores data which is indicative of a time error occurring before or after adjustment. A counter 7 is provided for counting a number of times that time data is not sufficiently received (as described in detail below).

A control circuit 8 is provided for controlling, among other things, the receiving circuit 1 dependent on the time error. The control circuit 8 may comprise a CPU, ROM, etc. A reception control circuit 9 supplies power to the receiving circuit 1 at a desired time. In accordance with the embodiment shown in FIG. 1, a predetermined reception time storing circuit 10 is provided for storing a predetermined reception time.

Figure 2:
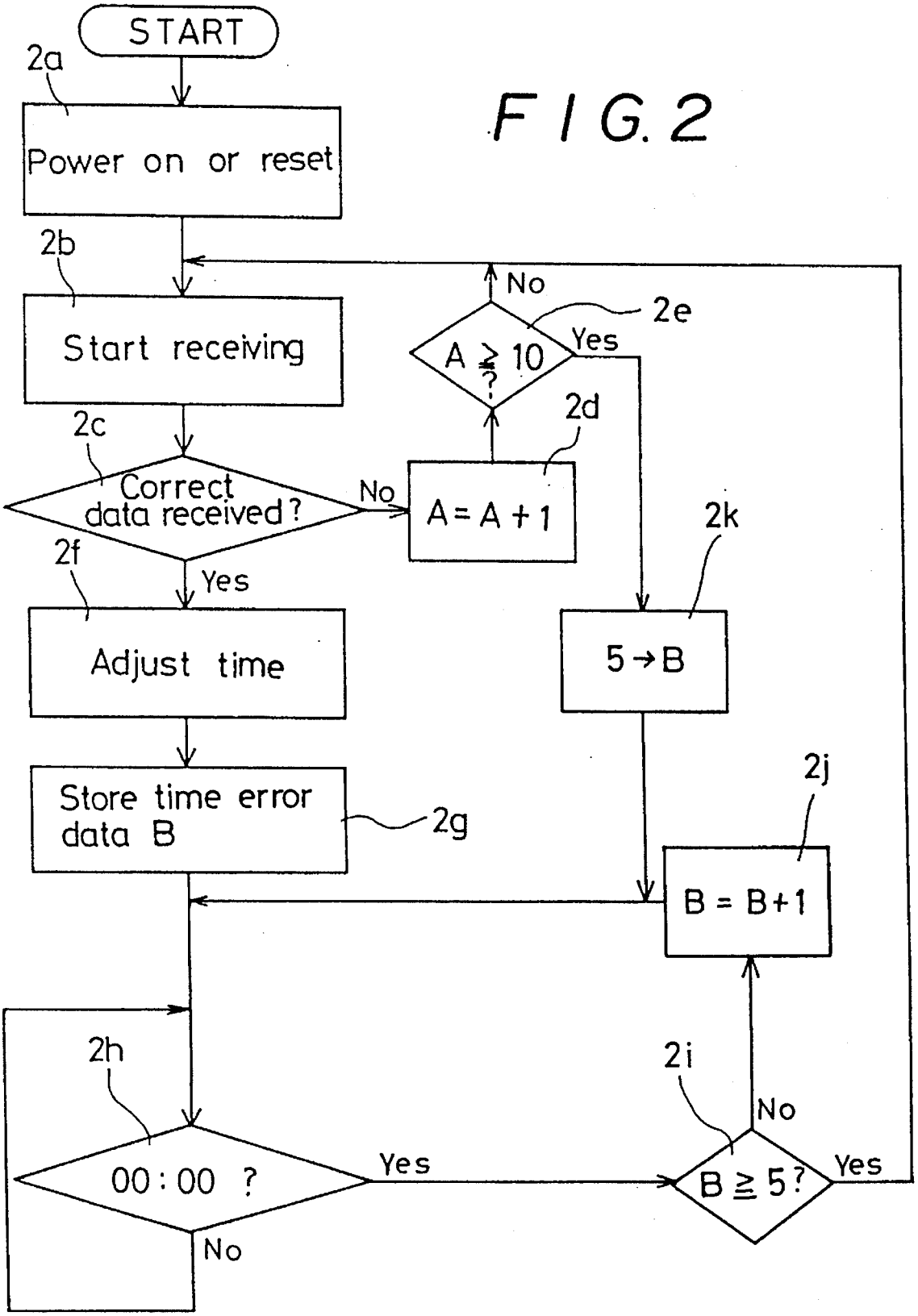
FIG. 2 is a flowchart for explaining the operation of the embodiment shown in FIG. 1.

The operation of the embodiment shown in FIG. 1 will be described hereinbelow with reference to FIG. 2. A power-on signal or a reset signal is generated whenever power (for example, from a battery or external source) is turned on. This power-on signal is inputted into the control circuit 8 (step 2*a*). In response to this signal, the control circuit 8 activates the reception control circuit 9. The reception control circuit 9 supplies power to the receiving circuit 1 to start the reception of the time code signal (step 2*b*). At this time, the signal received by the receiving circuit 1 is wave form shaped by the radio wave detecting circuit 2. The data detecting circuit 3 detects the time data included in this signal and transmits the detected time data to the control circuit 8.

The control circuit 8 judges whether the time data is correctly detected and received (step 2*c*). If the time data is not correctly detected because of reception failure due to, for example, noise or a weak signal, the control circuit 8 outputs a signal to the counter 7. The counter 7 counts the number A of reception failures (step 2*d*). The reception failure is checked by comparing the received time data with the several received data. If the number A has not reached a predetermined number of times (for example, ten times as shown in step 2*e*), the time data is received again. The above-mentioned operations are repeated until accurate time data can be received, or the number A of reception failures reaches a predetermined number (in this case, ten times).

By way of example, the reception control circuit 9 supplies power to the receiving circuit 1 to enable the same to receive the time code signal for 5 minutes. If one frame of the time code signal has a duration of one minute, 4 or 5 frames can be received during the 5-minute period. A reception failure is judged by comparing each received time data in the 4 or 5 frames so that if the received time data does not advance one minute per one frame, the control circuit 8 judges a reception failure.

If the time data is correctly detected during the above-mentioned operation step 2*c*), the control circuit 8 activates the adjusting circuit 5, so that the adjusting circuit 5 can adjust the time of the time counting circuit 4 on the basis of the received time data (step 2*f*). The time error data B is stored in the memory circuit 6 and is indicative of the time error occurring before and after adjustment (step 2*g*). In this embodiment, the time error data B is an absolute value of the time which has been adjusted, so that the time error B is an absolute value of a time difference between a time value determined from the correct time data and the current time before adjustment.

In summary, the control circuit 8 controls the adjusting circuit 5 and includes means for determining whether the correct time data is sufficiently received when the receiving circuit 1 is receiving the broadcast time signal, or when the received broadcast time signal is useful for its intended purpose. The counter 7 counts a number A of times the time data is not sufficiently received. The control circuit 8 includes comparing means for comparing the number A of times the time data is not sufficiently received with a predetermined number. If the time data is correctly received, the control circuit 8 controls the adjusting circuit to determine the time error B and adjust the current time on the basis of the received data. However, if the number A of times the time data is not sufficiently received exceeds the predetermined number, the control circuit 8 controls the adjusting circuit 5 to determine the time error on the basis of a predetermined value (i.e., B=5).

Furthermore, when the current time reaches the predetermined reception time (for example, 00:00 as shown in step 2*h*) which is stored in the predetermined reception time storing circuit 10, the control circuit 8 judges whether the time error data B stored in the memory circuit 6 is above a predetermined value (for example, 5 seconds or more as shown in step 2*i*). If the time error data B is 5 seconds or more, the process returns to step 2*b* and again executes the reception and adjustment operations. On the other hand, if the time error data B is less than 5 seconds, a predetermined value, such as 1 second, is added to the stored time error B and a new value of the time error data B is stored in the memory circuit 6 (step 2*j*). Then, the process returns to step 2*h*. Therefore, when the error to be adjusted is small, no time data reception and adjustment operations are executed. Thus, the power consumption is reduced by not requiring the time data reception and adjustment operations. Furthermore, if the time data cannot be detected correctly after the above-mentioned operations (steps 2*b*, 2*c*, 2*d* and 2*e*) have been repeated ten times, a value of 5 seconds is stored in the memory circuit 6 as the time error data B (step 2*k*). The process proceeds on to step 2*h*. In other words, the time data is compulsorily received by the receiving circuit 1 at the next predetermined reception time.

In summary, the memory circuit 6 stores the time error B and the predetermined reception storing circuit 10 stores a predetermined reception time. The control circuit 8 includes determining means for determining whether the time error B exceeds a predetermined value at the predetermined reception time. If the time error exceeds the predetermined value, then the control circuit 8 controls the receiving circuit 1 to receive the broadcast signal. If the time error B does not exceed the predetermined value, then the time error B is incremented.

In the above embodiment, the time data reception time is previously determined. However, other embodiments in which the next reception date and time are decided according to the time error data B will be described hereinbelow.

Figure 3:
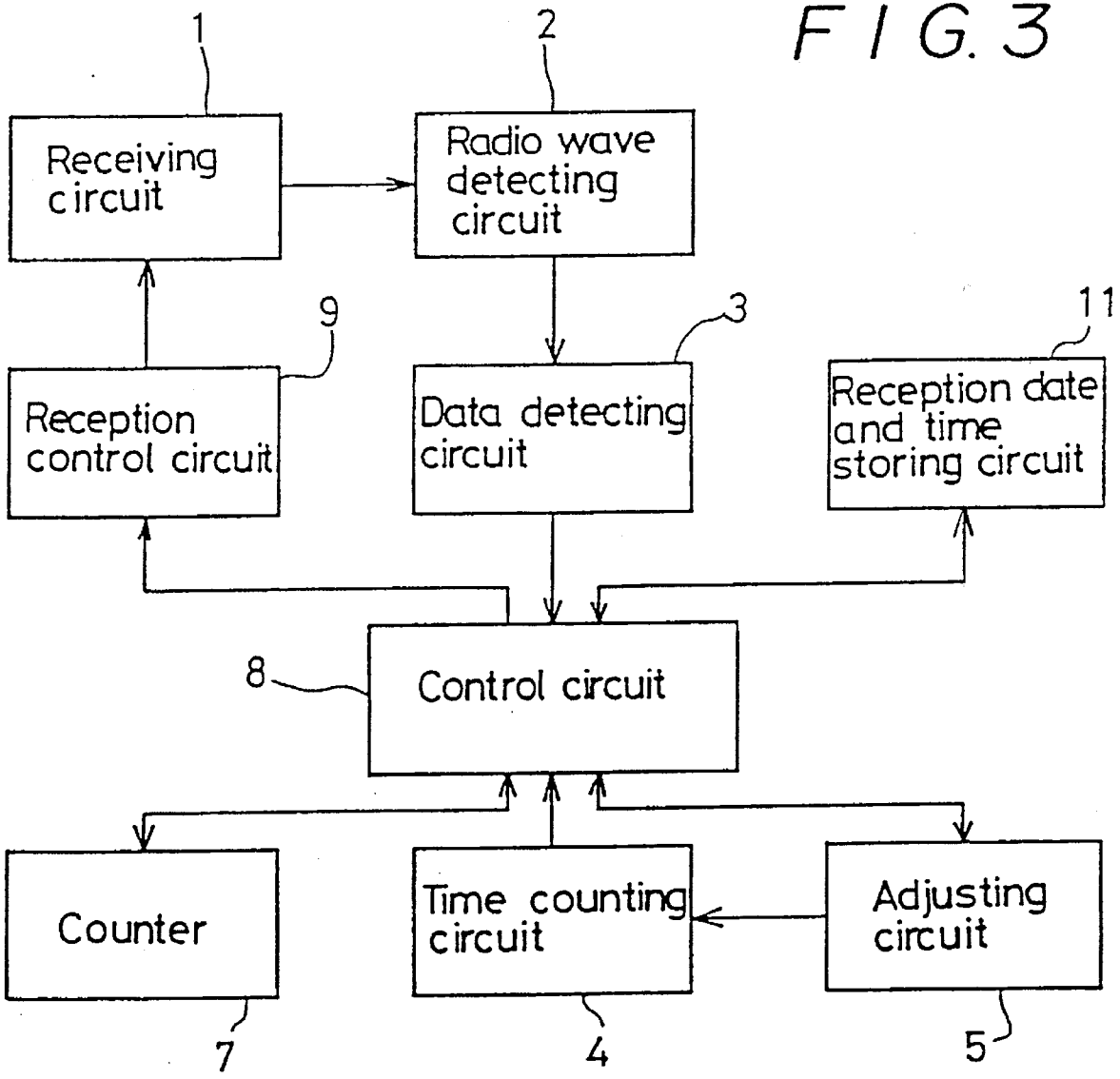
FIG. 3 is a block diagram showing another embodiment of a timepiece according to the present invention.

Referring to FIG. 3, the predetermined reception time storing circuit 10 of the embodiment shown in FIG. 1 is replaced by a reception date and time storing circuit 11. The reception date and time storing circuit 11 may include a RAM or the like and stores the next reception date and time. In FIG. 3, the same numerals denote the same circuits which have the same functions as described with reference to FIG. 1.

Figure 4:
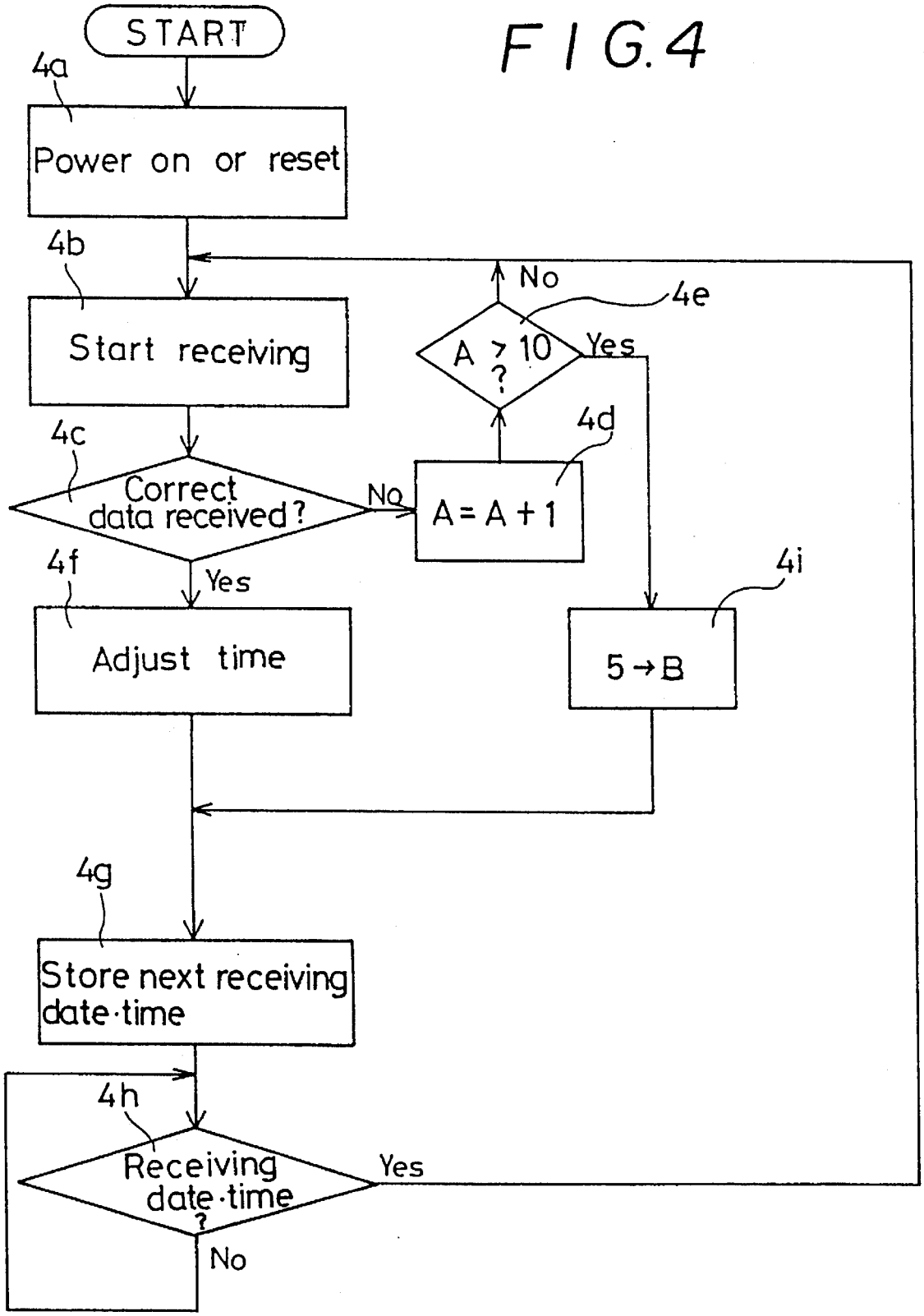
FIG. 4 is a flowchart for explaining the operation of the embodiment shown in FIG. 3.

The operation of the embodiment of the timepiece shown in FIG. 3 will be explained with reference to FIG. 4. In similar manner as described with reference to the embodiment shown in FIGS. 1 and 2, in response to an output signal obtained when a power source is turned on, reception of the time data is started (steps 4*a* and 4*b*) When the correct time data is detected (steps 4*c*, 4*d*, 4*e*), the time of the time counting circuit 4 is adjusted (step 4*f*), and the control circuit 8 decides the date and time for time data reception according to the time error data B. The decided next reception date and time are stored in the reception date and time storing circuit 11 (step 4*g*). Thereafter, the time data reception is executed and the adjusting operation is executed in the same way as described with reference to the embodiment shown in FIGS. 1 and 2 at the decided date and time (step 4*h*).

For example, when the time error data B is less than 1 second, a date 7 days after the current reception date is decided. When the time error data B is between 1 second and 3 seconds, a date 4 days after the current reception date is decided. When the time error data B is between 3 seconds and 5 seconds, a date two days after the current reception date is decided, and when the time error data B is greater than 5 seconds, a date 1 day after the current reception date is decided. The decided date is read from a ROM table within the control circuit 8 and then stored in the reception date and time storing circuit 11.

When the time error is small, since no reception and adjustment operations are executed, it is possible to reduce the power consumption. Further, when the next reception date and time is determined, since the number of accumulated days since January 1 is also included in the received time information, it is possible to determine the decided date by storing the number of accumulated days and adding the above-mentioned number of decided correction days to the accumulated day information.

In summary, the control circuit 8 includes deciding means for deciding a next reception date and time depending on the time error data B. The control circuit 8 controls the reception controlling means to receive the broadcast signal at the next reception date and time. The reception date and time storing circuit 11 stores the next reception date and time. The deciding means includes means for determining a number of accumulated days since January 1 from the correct time data, means for deciding a number of correction days dependent on the time error, and means for adding the accumulated days to the correction days to decide the next reception date and time.

Figure 5:
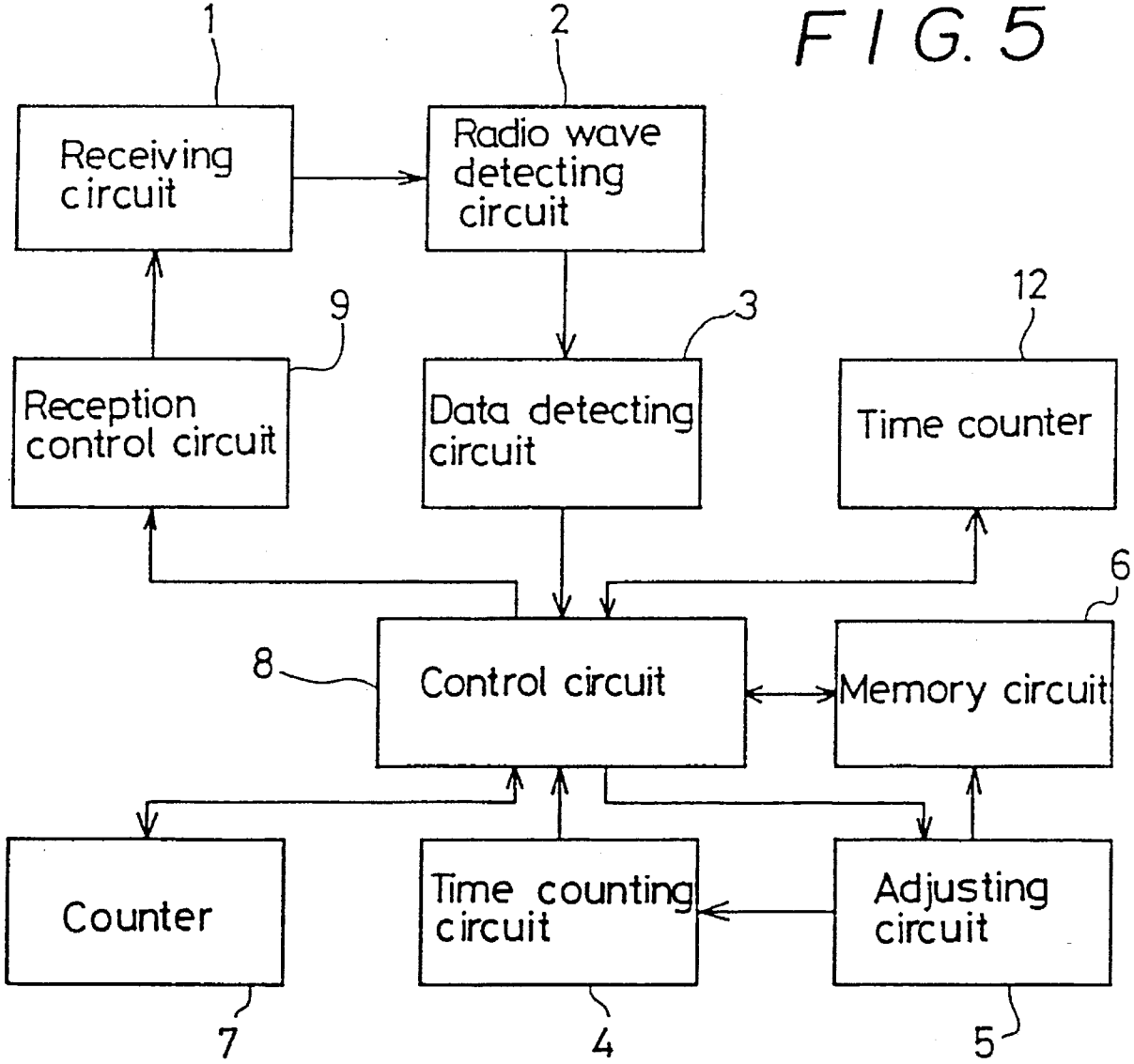
FIG. 5 is a block diagram showing a third embodiment of a timepiece according to the present invention.

In the second embodiment, the operation intervals of the receiving circuit 1 are determined on the basis of the reception time. However, it is also possible to determine the operation intervals on the basis of any required time interval. FIG. 5 shows an example of such an embodiment.

Referring to FIG. 5, the predetermined reception time storing circuit 10 of the embodiment shown in FIG. 1 is replaced by a time counter 12. In FIG. 5, the same reference numerals denote the same circuits which have the same functions as shown in FIG. 1.

Figure 6:
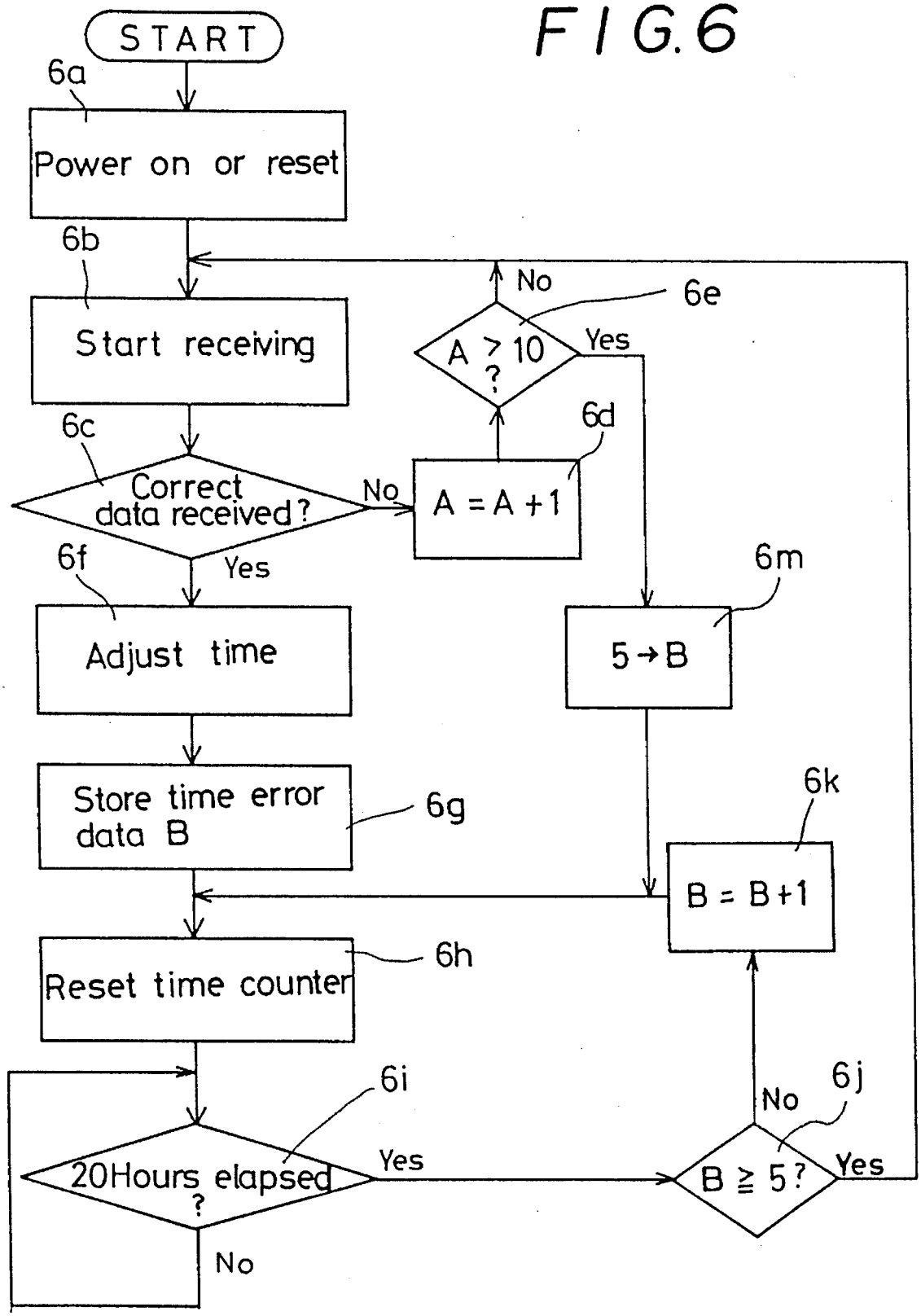
FIG. 6 is a flowchart for explaining the operation of the embodiment shown in FIG. 5.

The operation of this embodiment will be described hereinbelow with reference to FIG. 6. In a similar manner as in the afore-mentioned embodiments, in response to an output signal generated when the power is turned on, the reception operation starts (steps 6*a*, 6*b*). When correct time data is received (steps 6*c*, 6*d*, 6*e*), the time of the time counting circuit 4 is adjusted (step 6*f*), and the time error data B is stored in the memory circuit 6 (step 6*g*). At the same time, the time counter 12 is reset (step 6*h*), and when the time counter 12 counts 20 hours (step 6*i*), the control circuit 8 executes the same operation as in the aforementioned embodiments according to the time error data B (steps 6*j*, 6*k*).

In summary, an elapsed time counting circuit comprised of the time counter 12 counts a predetermined elapsed time. The control circuit 8 operates at the predetermined elapsed time for controlling the receiving circuit 1 to control reception of the broadcast signal.

In the embodiment described with reference to FIG. 6, the desired time interval is 20 hours. However, it is possible to freely determine this time interval.

Figure 7:
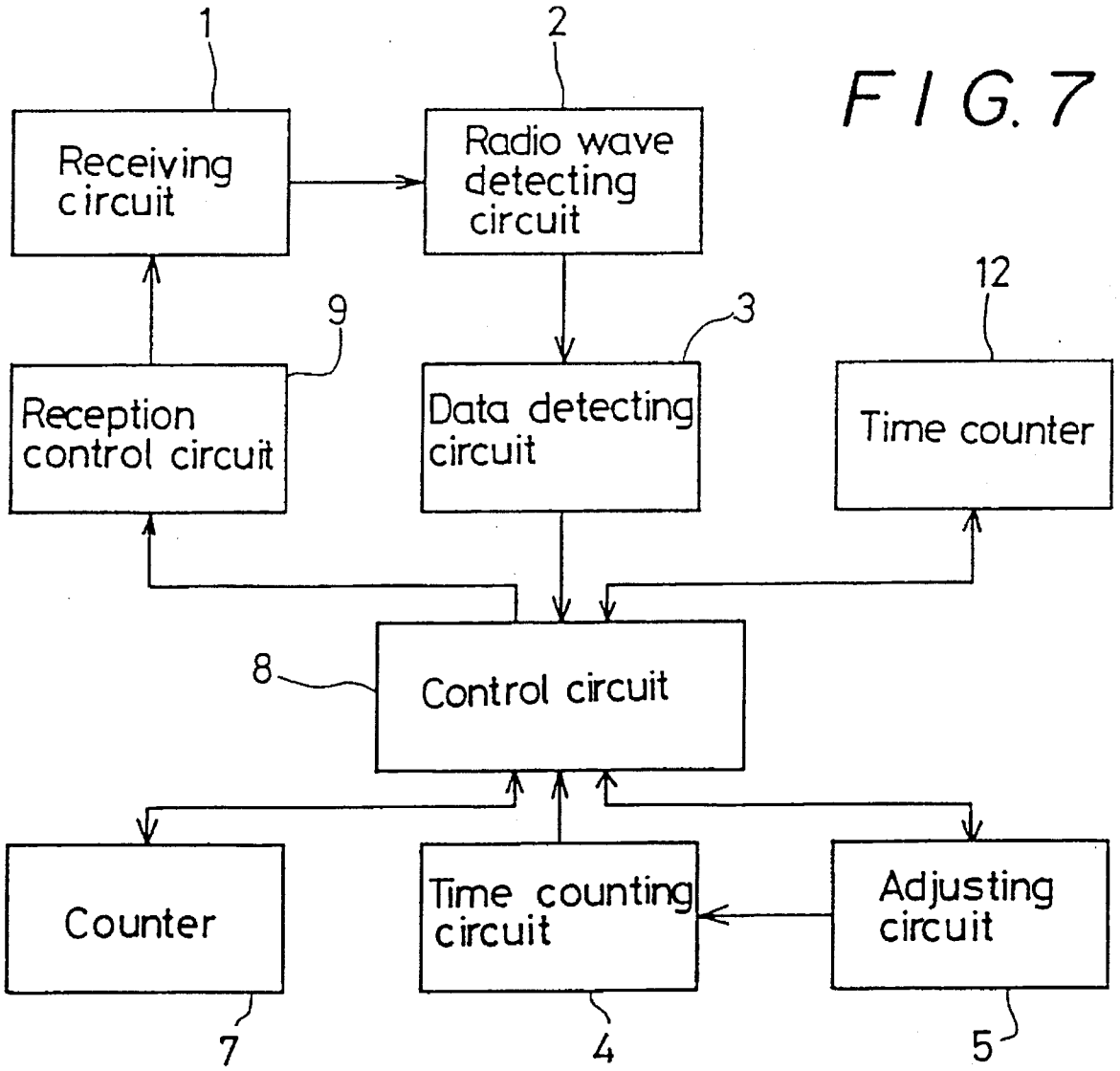
FIG. 7 is a block diagram showing a fourth embodiment of a timepiece according to the present invention.

Another embodiment in which the count time of the time counter can be modified according to the time error data B will be described hereinbelow with reference to FIGS. 7 and 8. In FIG. 7, the same numerals denote the same circuits which have the same functions as shown in FIG. 5.

Figure 8:
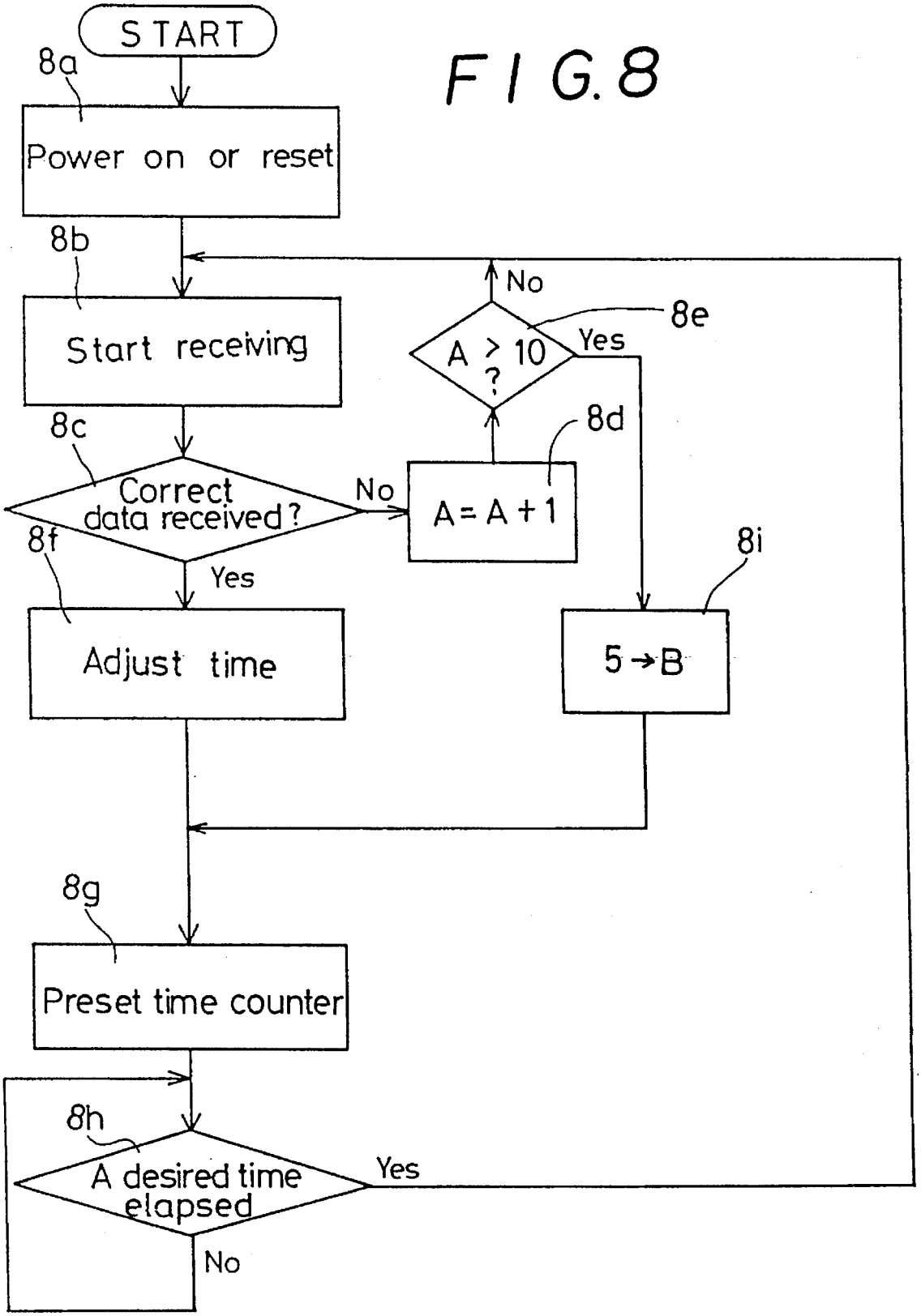
FIG. 8 is a flowchart for explaining the operation of the embodiment shown in FIG. 7.

As shown in FIG. 8, in the same way as in the aforementioned embodiments, in response to an output signal generated when the power is turned on, the reception operation starts (steps 8*a*, 8*b*). When correct time data is received (steps 8*c*, 8*d*, 8*e*), the time of the time counting circuit 4 is adjusted (step 8*f*). The control circuit 8 presets the time counter 12 by a desired time according to the time error data B (step 8*g*). When the time counter 12 counts the desired time (step 8*h*), the data reception and time adjustment operations are executed.

For example, when the time error data B is less than 1 second, the count time of the time counter 12 is preset to 100 hours. When the time error data B is between 1 second and 3 seconds, the count time of the time counter 12 is preset to 70 hours. When the time error data B is between 3 seconds and 5 seconds, the count time of the time counter 12 is preset to 40 hours, and when the time error data is greater than 5, the count time of the time counter 12 is preset to 24 hours. Thus, when the time error is small, since the reception and adjustment operations are not executed, it is possible to reduce the power consumption. Furthermore, the above mentioned respective preset times are previously written in a ROM table of the control circuit 8, and prescribed ones of the count times are read out according to the time error data B.

In summary, an elapsed time counting circuit comprised of the time counter 12 counts a predetermined elapsed time (desired time). The control circuit 8 operates at the predetermined elapsed time for controlling the reception control means to receive the broadcast signal. The control circuit 8 includes means for resetting the predetermined elapsed time with a count time depending on the time error.

In the above-mentioned embodiments, although the upper limit of the number of reception failures is determined to be 10 times, it is possible to set this upper limit value to any appropriate value. Furthermore, the operation intervals of the reception circuit 1 determined according to the time error B can be modified under due consideration of the precision of the time counting circuit 4.

Thus, in accordance with the present invention, as described above, since the time signal is received at intervals or times dependent on the time error obtained at the preceding adjustment operation, the reception operation is executed only when necessary so that it is possible to economize the power consumption of the timepiece.

I claim:

1. A timepiece receptive of a broadcast time signal for correcting a time error, comprising:

receiving means for receiving a broadcast time signal containing correct time data;

reception controlling means operative when activated for controlling the reception of the broadcast time signal by the receiving means;

time counting means for counting a current time;

adjusting means for determining a time error dependent on the correct time data and the current time and for adjusting the current time dependent on the time error; and a control circuit for determining a reception time dependent on the time error and for activating the reception controlling means to control the receiving means to receive the broadcast time signal at the determined reception time.

2. A timepiece according to claim 1; wherein the control circuit includes means for determining the reception time inversely proportional to the time error so that the more the time error is decreased the more the next activating time of the reception controlling means is delayed.

3. A timepiece according to claim 2; wherein the control circuit includes means for determining whether the correct time data is sufficiently received during a reception time when the receiving means is receiving the broadcast data, counting means for counting a number of times the correct time data is not sufficiently received, and comparing means for comparing the number of times the correct time data is not sufficiently received with a predetermined number, whereby if the correct time data is sufficiently received, the control circuit controls the adjusting means to determine the time error and adjust the current time dependent on the correct time data, whereas if the number of times the correct time data is not sufficiently received exceeds the predetermined number, the control circuit controls the adjusting means to determine the time error dependent on a predetermined value.

4. A timepiece according to claim 2; further comprising time error storing means for storing the time error; and reception time storing means for storing a predetermined reception time; and wherein the control circuit includes means for determining whether the time error exceeds a predetermined value at the predetermined reception time, means for activating the reception controlling means to control the receiving means to receive the broadcast time signal if the time error exceeds the predetermined value, and means for incrementing the time error stored in the time error storing means if the time error does not exceed the predetermined value.

5. A timepiece according to claim 2; wherein the control circuit includes deciding means for deciding a next reception date and time depending on the time error, and means for activating the reception controlling means to control the receiving means to receive the broadcast time signal at the next reception date and time; and further comprising reception date and time storing means for storing the next reception date and time.

6. A timepiece according to claim 2; further comprising an elapsed time counting circuit for counting a predetermined elapsed time; and wherein the control circuit includes means for activating the reception controlling means to control the receiving means to receive the broadcast time signal at the predetermined elapsed time.

7. A timepiece according to claim 2; further comprising an elapsed time counting circuit for counting a predetermined elapsed time; and wherein the control circuit includes means for activating the reception controlling means to control the receiving means to receive the broadcast time signal at the predetermined elapsed time, and means for resetting the predetermined elapsed time with a count time depending on the time error.

8. A timepiece according to claim 1; wherein the control circuit includes means for determining a time interval between an activating time of the reception controlling means and a next activating time of the reception controlling means inversely proportional to the time error so that as the time error is decreased the time interval is increased.

9. A timepiece according to claim 8; wherein the control circuit includes means for determining whether the correct time data is sufficiently received during a reception time when the receiving means is receiving the broadcast data, counting means for counting a number of times the correct time data is not sufficiently received, and comparing means for comparing the number of times the correct time data is not sufficiently received with a predetermined number, whereby if the correct time data is sufficiently received, the control circuit controls the adjusting means to determine the time error and adjust the current time dependent on the correct time data, whereas if the number of times the correct time data is not sufficiently received exceeds the predetermined number, the control circuit controls the adjusting means to determine the time error dependent on a predetermined value.

10. A timepiece according to claim 8; further comprising time error storing means for storing the time error; and reception time storing means for storing a predetermined reception time; and wherein the control circuit includes means for determining whether the time error exceeds a predetermined value at the predetermined reception time, means for activating the reception controlling means to control the receiving means to receive the broadcast time signal if the time error exceeds the predetermined value, and means for incrementing the time error stored in the time error storing means if the time error does not exceed the predetermined value.

11. A timepiece according to claim 8; wherein the control circuit includes deciding means for deciding a next reception date and time depending on the time error, and means for activating the reception controlling means to control the receiving means to receive the broadcast time signal at the next reception date and time; and further comprising reception date and time storing means for storing the next reception date and time.

12. A timepiece according to claim 8; further comprising an elapsed time counting circuit for counting a predetermined elapsed time; and wherein the control circuit includes means for activating the reception controlling means to control the receiving means to receive the broadcast time signal at the predetermined elapsed time.

13. A timepiece according to claim 8; further comprising an elapsed time counting circuit for counting a predetermined elapsed time; and wherein the control circuit includes means for activating the reception controlling means to control the receiving means to receive the broadcast time signal at the predetermined elapsed time, and means for resetting the predetermined elapsed time with a count time depending on the time error.

14. A timepiece according to claim 1; wherein the control circuit includes means for determining whether the correct time data is sufficiently received during a reception time when the receiving means is receiving the broadcast data, counting means for counting a number of times the correct time data is not sufficiently received, and comparing means for comparing the number of times the correct time data is not sufficiently received with a predetermined number, whereby if the correct time data is sufficiently received, the control circuit controls the adjusting means to determine the time error and adjust the current time dependent on the correct time data, whereas if the number of times the correct time data is not sufficiently received exceeds the predetermined number, the control circuit controls the adjusting means to determine the time error dependent on a predetermined value.

15. A timepiece according to claim 1; further comprising time error storing means for storing the time error; and reception time storing means for storing a predetermined reception time; and wherein the control circuit includes means for determining whether the time error exceeds a predetermined value at the predetermined reception time, means for activating the reception controlling means to control the receiving means to receive the broadcast time signal if the time error exceeds the predetermined value, and means for incrementing the time error stored in the time error storing means if the time error does not exceed the predetermined value.

16. A timepiece according to claim 1; wherein the control circuit includes deciding means for deciding a next reception date and time depending on the time error, and means for activating the reception controlling means to control the receiving means to receive the broadcast time signal at the next reception date and time; and further comprising reception date and time storing means for storing the next reception date and time.

17. A timepiece according to claim 1; further comprising an elapsed time counting circuit for counting a predetermined elapsed time; and wherein the control circuit includes means for activating the reception controlling means to control the receiving means to receive the broadcast time signal at the predetermined elapsed time.

18. A timepiece according to claim 1; further comprising an elapsed time counting circuit for counting a predetermined elapsed time; and wherein the control circuit includes means for activating the reception controlling means to control the receiving means to receive the broadcast time signal at the predetermined elapsed time, and means for resetting the predetermined elapsed time with a count time depending on the time error.

19. A timepiece receptive of a broadcast time signal for correcting a time error; comprising:

receiving means for receiving a broadcast time signal containing correct time data;

reception controlling means operative when activated for controlling the receiving means to receive the broadcast time signal;

time counting means for counting a current time;

adjusting means for determining a time error dependent on the correct time data and the current time and for adjusting the current time dependent on the time error; and a control circuit for determining a reception time depending on the time error and for activating the reception controlling means to control the receiving means to receive the broadcast signal at the determined reception time, the control circuit including means for determining whether the correct time data is sufficiently received, counting means for counting a number of times the correct time data is not sufficiently received, and comparing means for comparing the number of times the correct time data is not sufficiently received with a predetermined number, whereby the control circuit controls the adjusting means to determine the time error and to adjust the current time dependent on the correct time data if the correct time data is sufficiently received, and the control circuit controls the adjusting means to determine the time error dependent on a predetermined value if the number of times the correct time data is not sufficiently received exceeds the predetermined number.

20. A timepiece according to claim 19; wherein the control circuit includes means for determining the reception time inversely proportional to the time error so that the more the time error is decreased the more the next activating time of the reception controlling means is delayed.

21. A timepiece according to claim 20; wherein the adjusting means includes means for determining the time error as an absolute value of a time difference between a time value determined from the correct time data and the current time before adjustment of the current time.

22. A timepiece according to claim 20; further comprising time error storing means for storing the time error; and reception time storing means for storing a predetermined reception time; and wherein the control circuit includes means for determining whether the time error exceeds a predetermined value at the predetermined reception time, means for activating the reception controlling means to control the receiving means to receive the broadcast time signal if the time error exceeds the predetermined value, and means for incrementing the time error stored in the time error storing means if the time error does not exceed the predetermined value.

23. A timepiece according to claim 20; wherein the control circuit includes deciding means for deciding a next reception date and time depending on the time error, and means for activating the reception controlling means to control the receiving means to receive the broadcast time signal at the next reception date and time; and further comprising reception date and time storing means for storing the next reception date and time.

24. A timepiece according to claim 23; wherein the deciding means includes means for determining from the correct time data a number of accumulated days since January 1, means for deciding a number of correction days dependent on the time error, and means for adding the number of accumulated days to the number of correction days to decide the next reception date and time.

25. A timepiece according to claim 20; further comprising an elapsed time counting circuit for counting a predetermined elapsed time; and wherein the control circuit includes means for activating the reception controlling means to control the receiving means to receive the broadcast time signal at the predetermined elapsed time.

26. A timepiece according to claim 20; further comprising an elapsed time counting circuit for counting a predetermined elapsed time; and wherein the control circuit includes means for activating the reception controlling means to control the receiving means to receive the broadcast time signal at the predetermined elapsed time, and means for resetting the predetermined elapsed time with a count time depending on the time error.

27. A timepiece according to claim 26; wherein the control circuit includes a RAM for storing the count time.

28. A timepiece according to claim 19; wherein the control circuit includes means for determining a time interval between an activating time of the reception controlling means and a next activating time of the reception controlling means inversely proportional to the time error so that as the time error is decreased the time interval is increased.

29. A timepiece according to claim 28; wherein the adjusting means includes means for determining the time error as an absolute value of a time difference between a time value determined from the correct time data and the current time before adjustment of the current time.

30. A timepiece according to claim 28; further comprising time error storing means for storing the time error; and reception time storing means for storing a predetermined reception time; and wherein the control circuit includes means for determining whether the time error exceeds a predetermined value at the predetermined reception time, means for activating the reception controlling means to control the receiving means to receive the broadcast time signal if the time error exceeds the predetermined value, and means for incrementing the time error stored in the time error storing means if the time error does not exceed the predetermined value.

31. A timepiece according to claim 28; wherein the control circuit includes deciding means for deciding a next reception date and time depending on the time error, and means for activating the reception controlling means to control the receiving means to receive the broadcast time signal at the next reception date and time; and further comprising reception date and time storing means for storing the next reception date and time.

32. A timepiece according to claim 31; wherein the deciding means includes means for determining from the correct time data a number of accumulated days since January 1, means for deciding a number of correction days dependent on the time error; and means for adding the number of accumulated days to the number of correction days to decide the next reception date and time.

33. A timepiece according to claim 28; further comprising an elapsed time counting circuit for counting a predetermined elapsed time; and wherein the control circuit includes means for activating the reception controlling means to control the receiving means to receive the broadcast time signal at the predetermined elapsed time.

34. A timepiece according to claim 28; further comprising an elapsed time counting circuit for counting a predetermined elapsed time; and wherein the control circuit includes means for activating the reception controlling means to control the receiving means to receive the broadcast time signal at the predetermined elapsed time, and means for resetting the predetermined elapsed time with a count time depending on the time error.

35. A timepiece according to claim 34; wherein the control circuit includes a RAM for storing the count time.

36. A timepiece according to claim 19; wherein the adjusting means includes means for determining the time error as an absolute value of a time difference between a time value determined from the correct time data and the current time before adjustment of the current time.

37. A timepiece according to claim 19; further comprising time error storing means for storing the time error; and reception time storing means for storing a predetermined reception time; and wherein the control circuit includes means for determining whether the time error exceeds a predetermined value at the predetermined reception time, means for activating the reception controlling means to control the receiving means to receive the broadcast time signal if the time error exceeds the predetermined value, and means for incrementing the time error stored in the time error storing means if the time error does not exceed the predetermined value.

38. A timepiece according to claim 19; wherein the control circuit includes deciding means for deciding a next reception date and time depending on the time error, and means for activating the reception controlling means to control the receiving means to receive the broadcast time signal at the next reception date and time; and further comprising reception date and time storing means for storing the next reception date and time.

39. A timepiece according to claim 38; wherein the deciding means includes means for determining from the correct time data a number of accumulated days since January 1, means for deciding a number of correction days dependent on the time error, and means for adding the number of accumulated days to the number of correction days to decide the next reception date and time.

40. A timepiece according to claim 19; further comprising an elapsed time counting circuit for counting a predetermined elapsed time; and wherein the control circuit includes means for activating the reception controlling means to control the receiving means to receive the broadcast time signal at the predetermined elapsed time.

41. A timepiece according to claim 19; further comprising an elapsed time counting circuit for counting a predetermined elapsed time; and wherein the control circuit includes means for activating the reception controlling means to control the receiving means to receive the broadcast time signal at the predetermined elapsed time, and means for resetting the predetermined elapsed time with a count time depending on the time error.

42. A timepiece according to claim 41; wherein the control circuit includes a RAM for storing the count time.

43. A timepiece receptive of a broadcast time signal for correcting a time error, comprising:

receiving means operative when activated for receiving a broadcast time signal containing correct time data;

time adjusting means for counting a current time;

adjusting means for determining a time error dependent on the correct time data and the current time and for adjusting the current time dependent on the time error; and controlling means for determining a reception time dependent on the time error and for activating the receiving means to receive the broadcast time signal at the determined reception time.

44. A timepiece according to claim 43; wherein the controlling means includes means for determining the reception time inversely proportional to the time error so that the more the time error is decreased the more a next activating time of the receiving means is delayed.

45. A timepiece according to claim 43; wherein the controlling means includes means for determining a time interval between an activating time of the receiving means and a next activating time of the receiving means inversely proportional to the time error so that as the time error is decreased the time interval is increased.

* * * * *